United States Patent [19]

Figaro

[11] Patent Number: 5,067,682

[45] Date of Patent: Nov. 26, 1991

[54] BOOK HOLDER

[76] Inventor: Davy J. Figaro, 9304 Ferguson Ct., Sebastopol, Calif. 95472

[21] Appl. No.: 377,261

[22] Filed: Jul. 10, 1989

[51] Int. Cl.[5] ..... A47B 97/04

[52] U.S. Cl. ..... 248/453; 248/457; 248/458

[58] Field of Search ..... 248/453, 454, 455, 457, 248/458, 446, 447, 448

[56] References Cited

U.S. PATENT DOCUMENTS

| | | | |
|---|---|---|---|
| 97,710 | 12/1869 | Sherman . | |
| 112,984 | 3/1871 | Thompson . | |
| 180,106 | 7/1876 | Brainard . | |
| 298,039 | 5/1884 | Swartz . | |
| 362,060 | 5/1887 | Clark . | |
| 490,569 | 1/1893 | Lehman . | |
| 564,964 | 8/1896 | Blackmer . | |
| 719,386 | 1/1903 | Smith . | |
| 825,072 | 7/1906 | Power et al. . | |
| 1,197,233 | 9/1916 | Plamandan et al. . | |
| 1,220,705 | 3/1917 | Tayte | 248/453 |
| 1,245,890 | 11/1917 | Dunmar . | |
| 1,300,045 | 4/1919 | Tavi . | |
| 1,864,807 | 6/1932 | Dahlgren . | |
| 2,346,703 | 4/1944 | Raven et al. | 248/453 |
| 2,609,636 | 9/1952 | Stone | 248/453 |
| 2,691,240 | 10/1954 | Kraus | 45/80 |
| 3,098,314 | 7/1963 | Degorski et al. | 248/453 |
| 3,460,795 | 8/1969 | Dahlin | 248/453 X |
| 3,603,554 | 9/1971 | Dickinson | 248/453 |
| 3,952,989 | 4/1976 | Banister Hatcher | 248/453 |
| 3,991,967 | 11/1976 | Sack | 248/448 |
| 4,116,413 | 9/1978 | Andersen | 248/455 X |
| 4,145,022 | 3/1979 | Comfort | 248/453 |
| 4,378,102 | 3/1983 | Portis, Jr. | 248/460 |
| 4,739,960 | 4/1988 | Adler | 248/453 |

*Primary Examiner*—Ramon O. Ramirez

[57] ABSTRACT

A book holder utilizing an "L" shaped swinging-assembly as an adjustable support for the bottom of a book. The assembly can be swung out to adjust for thick books, and it automatically swings back to the correct position under the influence of gravity. A spring loaded page retainer presses the pages open, and the page retainer can be rotated down out of the path of the pages so that the pages can be turned. The page retainer stays down to allow for flipping through pages of a book.

7 Claims, 3 Drawing Sheets

FIG 6

FIG 6
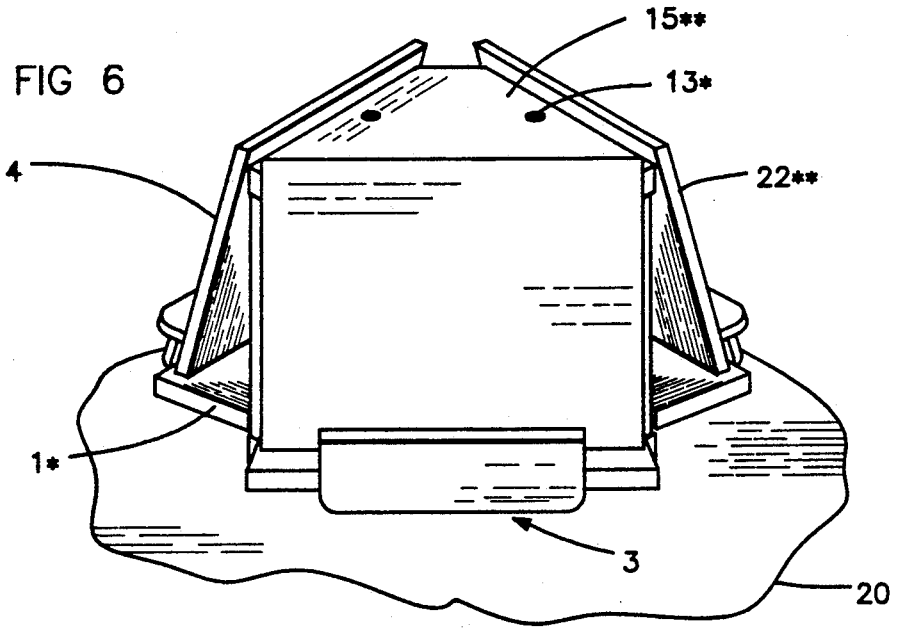
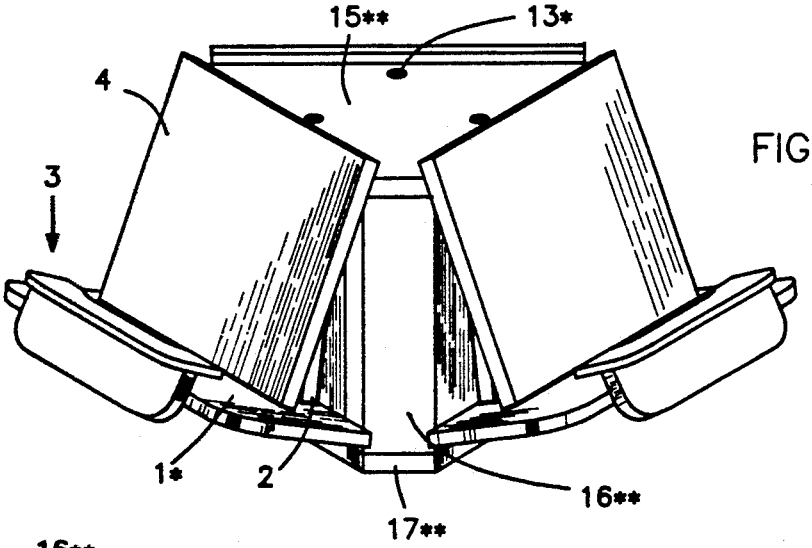
FIG 6A
FIG 6C
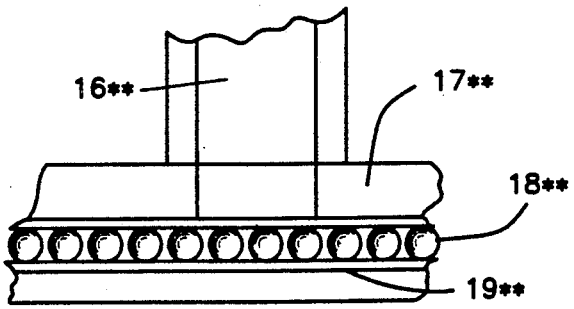
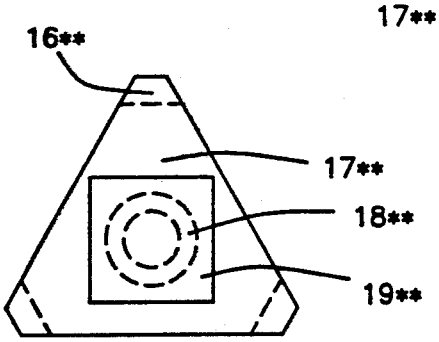
FIG 6B

BOOK HOLDER

BACKGROUND

1. Field of Invention

This invention is in the field of book holder, note holders, and stands that hold books open.

2. Description of Prior Art

Previous book holders and copy holders have been restrained for all practical purposes by a paradox: if they are adaptable to different books and successfully hold books open, they are often too complicated and difficult to use. If they are simpler in construction and easy to use, then they are often limited in application and ineffective.

One attribute of a good book holder is the ability to accommodate books of different thicknesses. U.S. Pat. No. 490,569 by Lehman, 24 Jan. 1893, achieves such a result by utilizing fixed page holders in front of the book, along with a spring equipped back rest behind the book, which pushes the book open against the page holders. Although a wide range of thicknesses are allowed by such a device, the page holders would tend to get in the way of turning the pages, making it cumbersome to use in practice.

Another version which can potentially hold thick books and does not require much space is U.S. Pat. No. 1,675,621 by Spencer, 3 July 1928. Spencer uses a wire frame as a base and backrest, and then hangs a wire book support from the horizontal crosswire at the top of the wire frame, thus allowing the entire book support to swing forward and backward relative to the backrest. The book support has a lip or page holder at the front of the section that the bottom of the book rests upon. When the book support swings back, the lip tends to press the pages back against the book and backrest.

Like Lehman, Spencer makes it cumbersome to turn pages, especially to flip through many pages. The permanent lips in these two book stands do not allow for full and free clearance to easily turn pages.

Bent wire in Spencer's design also makes it difficult to use for referring to smaller sized notepaper: The notepaper may fall through the bottom.

A common type of design which makes it relatively easy to turn pages is represented by U.S. Pat. No. 1,864,807 by Dahlgren, 28 June 1932. Dahlgren utilizes a spring loaded clip as a page holder, which can be pulled all the way down below the base upon which the book rests, thus facilitating the turning of pages. Although Dahlgren's stand has some flexibility in accommodating books of different thicknesses, it has some inherent limitations in practice. If Dahlgren's principle were used to build a stand that could hold widely varied thicknesses, it would have a very long lever arm in the clip, from the pivot point to the point of contact with the pages. A long lever arm is cumbersome to deal with. In addition, a long lever arm takes up significant space when it is folded down for page turning. These problems are also illustrated with U.S. Pat. No. 719,386 by Smith, 27 Jan. 1903.

Many book holders have the problem of being loaded with various adjustments: U.S. Pat. No. 3,991,967 by Sack, 16 Nov. 1976, for example. Sack's design appears to be effective at holding books open and accommodating different thicknesses. But it has about five different adjustments for the page holding mechanism. Sliding page press, clampable thickness adjustment, etc.

U.S. Pat. No. 4,378,102 by Portis, Jr. et al., 29 May 1983, has the advantage of simplicity and functionality. One problem, however, is that two page holders must be adjusted before a page can be turned. A page holder, consisting of a string with a weight attached at the bottom, hangs down from each side. Each string must be pulled from a groove in the shelf and put out of the way before a page or pages can be turned.

The above mentioned Prior Art represent some of the best designs in the field. There are many other similar book holders which have problems similar to the ones outlined above. These include:

U.S. Pat. No. 97,710 by Sherman, 7 Dec. 1869;
U.S. Pat. No. 298,039 by Swartz, 6 May 1884;
U.S. Pat. No. 1,245,890 by Dunmar, 6 Nov. 1917;
U.S. Pat. No. 1,300,045 by Tavi, 8 Apr. 1919;
U.S. Pat. No. 2,691,240 by Kraus, 12 Oct. 1954;
U.S. Pat. No. 4,123,029 Gillotti, 31 Oct. 1978;
U.S. Pat. No. 4,145,022 by Comfort, 20 Mar. 1979.

OBJECTS & ADVANTAGES

My invention has the objective of holding open one or several books, in the simplest possible manner, with an automatic adaptability to various sized books and other reading material. This should be accomplished with ease and simplicity of operation.

Several objects and advantages of my invention are to provide a book holder:

(a) which has a book support system capable of holding books in an open upright position, and to hold notepaper and other reading material in an upright position;
(b) which holds the pages open, and allows for the easy turning of a page or flipping through of many pages, without blockage by the page press;
(c) which holds the pages open in an effective manner by means of contoured page press;
(d) which easily and automatically adjusts to different sized and very thick books without having to readjust the stand each time a different book is inserted;
(e) which has built in bookmarks to keep track of several reference areas simultaneously;
(f) which requires a minimum amount of natural uncomplicated hand motions for its operation;
(g) which as one embodiment uses a minimum of desk space.
(h) which as another embodiment has several accessible book holders in one revolving unit, such that each book holder contains objects and advantages (a) through (f).

Further objects and advantages of my invention will become apparent from a consideration of the drawings and ensuing description of the invention and its operation.

DESCRIPTION OF DRAWINGS

FIG. 6 is a perspective view of three-sided embodiment 3, with no hidden lines showing.

FIG. 6A is a side perspective view of embodiment 3, with no hidden lines showing.

FIG. 6B is a view of the base portion of embodiment 3 from underneath looking up, showing the tri-base, vertical-support, bearing, and revolving-base.

FIG. 6C is a cutaway side view of embodiment 3 showing how the bearing is situated.

REFERENCE NUMERALS IN DRAWINGS

"E" stands for embodiment—"E1" means embodiment 1.

a angle between face (4) and table surface (20)

b angle between vertical-swing & book-support

| | |
|---|---|
| 1 | book-support E1 |
| 1* | book-support E2,3 |
| 2 | vertical-swing E1 |
| 2* | vertical-swing E2,3 |
| 3 | spring-clip (parts 3a & 3b) E1,2,3 |
| 3A | page-press E1,2,3 |
| 3B | spring-lever E1,2,3 |
| 4 | face E1,2,3 |
| 5 | swing-stop E1 |
| 6 | spring-hinge E1,2,3 |
| 6A | spring-pivot-point E1,2,3 |
| 7 | spring E1,2,3 |
| 8 | groove E1,2,3 |
| 9 | side E1 |
| 9* | side E2 |
| 10 | swing-hinge E1 |
| 10* | swing-hinge E2,3 |
| 11 | bookmark E1,2,3 |
| 12* | top-cross E2 |
| 13* | swing-hinge-bolt E2,3 |
| 14* | single-base E2 |
| 15** | tri-top E3 |
| 16** | vertical-support E3 |
| 17** | revolving-base E3 |
| 18** | bearing E3 |
| 19** | tri-base E3 |
| 22** | tri-top-corner E3 |
| 23* | swing-hinge washer E2,3 |

DESCRIPTION OF INVENTION

Figure 1:
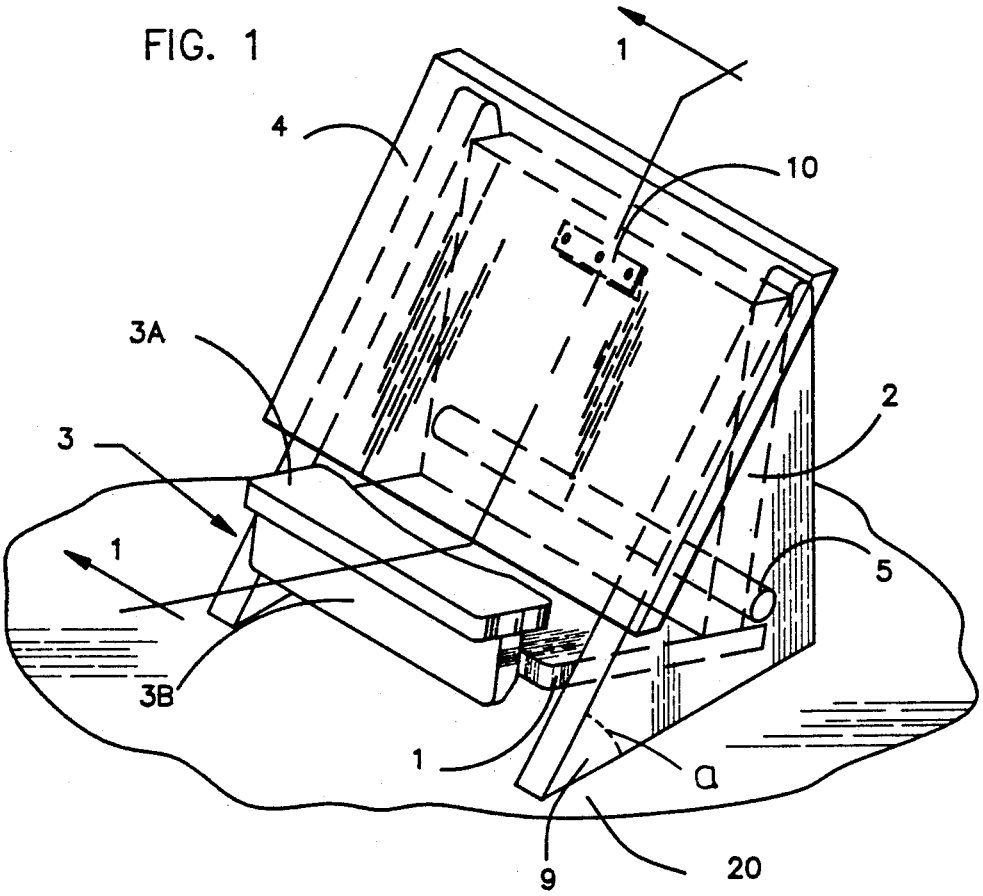
FIG. 1 is a perspective view of embodiment 1 of the book holder.
Figure 2:
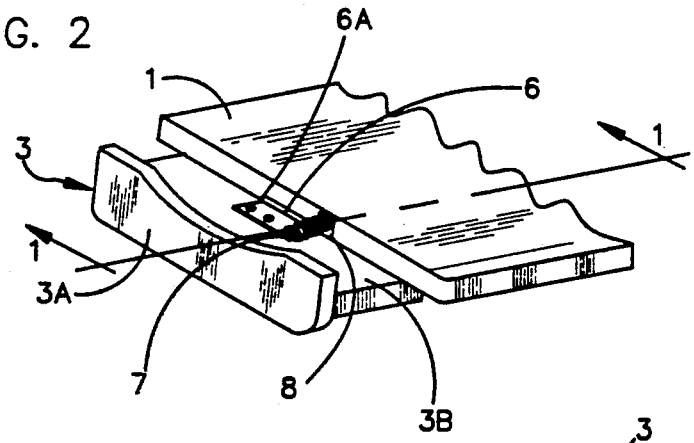
FIG. 2 is a perspective view of an open page holder, applicable to all embodiments.
Figure 3:
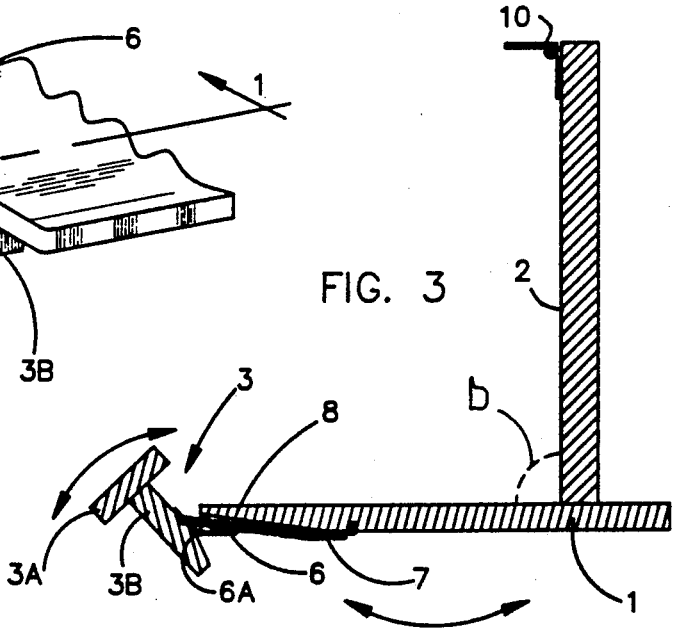
FIG. 3 is a sectional view of the swinging-assembly along the line (1—1) in FIGS. 1&2 for embodiment 1.
Figure 5:
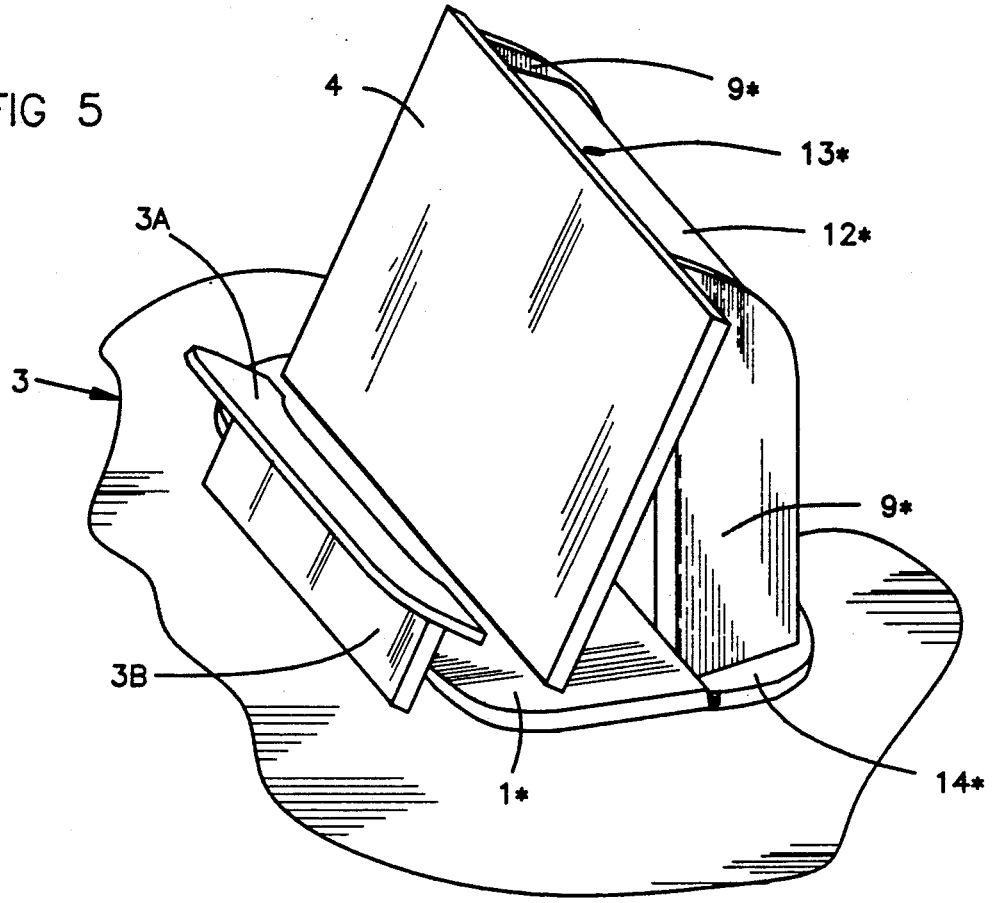
FIG. 5 is a perspective view of embodiment 2 with no hidden lines showing.

A typical embodiment of this book hôlder is shown in FIGS. 1-3. A book support 1 is secured at an approximately 90 degree or slightly acute angle b to a vertical-swing 2 forming an L-shaped assembly. The securing means used could be any one desired. A swing-hinge 10 is secured at the free end of vertical swing 2 to secure the L-shaped assembly to a stand. The stand as seen in FIG. 1 comprises two vertical sides 9 and a front or face element 4. Face element 4 is inclined at an upright angle a relative to a table surface 20, generally greater than 45 degrees. The angle a is set by means of the sides 9, which are shaped so that the front edges of the sides are angled at the angle a relative to the table surface. The face element 4 is attached to the sides 9 so that face 4 is at suitable distance up from table surface 20.

The swing-hinge 10 is secured to the top of face element 4 allowing the L-shaped assembly to swing with respect to the stand.

A stop 5 is attached between the two sides 9, providing a positive stop for vertical swing 2 at a point where the latter still has a tendency to swing back away from face element 4 under the influence of gravity. Stop 5 also provides additional stability to the two sides 9.

Book-support 1 extends from behind vertical-swing 2 to a point one to two inches in front of face element 4 when the L-shaped assembly is swung all the way back to the stop 5.

A spring-clip 3 is attached by spring-hinge 6 to the free end of book support 1 such that it is free to rotate from the fully up position of FIG. 1 to the fully down position of FIG. 2. A spring (7) is connected to the spring-hinge 6 or spring-clip 3, from where it runs along a groove (8) to the bottom surface of element 1, providing a closing force on spring-clip 3, and an opening pressure on the pages of an open book as will be explained later during the rotation of clip 3.

Figure 4:
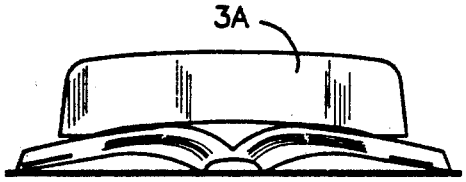
FIG. 4 is a top view of the page holder showing how it curves with a book

A spring-lever 3B is connected to page-press 3A which has a curved edge to follow the curve of the noncentral part of an open book; as seen in FIG. 4. The back of element 3A, the end which contacts the pages, is approximately ¾ of an inch above element 1 when in the fully up position.

Bookmark 11 consists of a strip or strips of cloth or similar material which are fastened to the back of face element 4 or to vertical-swing 2 such that a number of permanent bookmarks may hang in front of element 4.

Embodiment 2 has the same clip 3, spring 7, hinge 6, and groove 8 as embodiment 1. However, book support 1* may be as wide as or wider then the rest of the book holder in the lateral direction. Vertical-swing 2* may need its top end cut at an angle other then perpendicular in order to provide room for top-cross 12*. Sides 9* support face element 4 at the appropriate angle, support top-cross 12*, and provide a stop for the swinging assembly. Swing hinge 10* is attached to the top of angled vertical swing 2* and to top-cross 12*. Swing-hinge bolt 13* holds hinge 10* to top cross 12*, and also extends through top-cross 12* in order to also fasten down bookmark 11. Single-base 14* extends between the sides 9* and forward to a point where it approximately lines up with face 4, thus providing stability for the book holder.

Figure 5A:
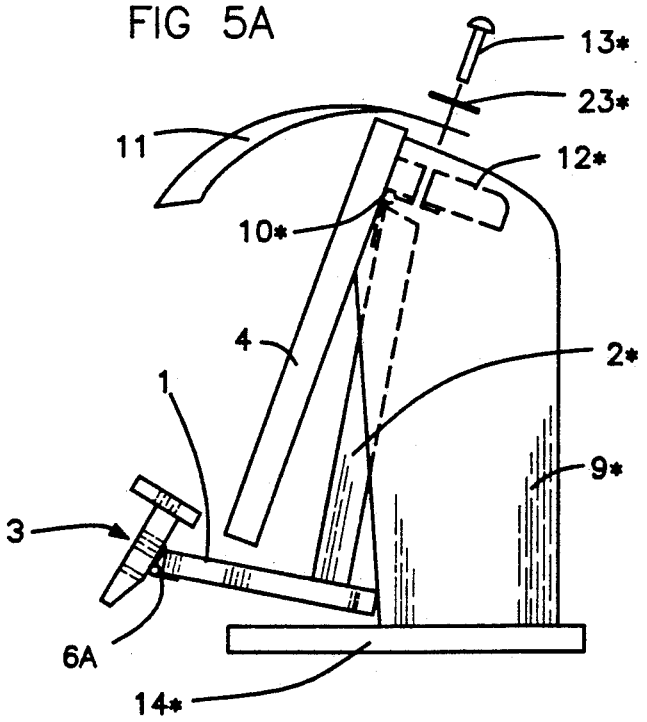
FIG. 5A is a side view of embodiment 2 with hidden lines showing.

Embodiment 3 has the same swinging-assembly as embodiment 2, except that it has three of them arranged on a revolving structure. There are three faces 4, each one being the same as in embodiments 1 and 2. The faces 4 are connected to tri-top 15** by swing-hinge-bolts 13*, in a manner similar to embodiments 2 (FIGS. 5A & 6A). Each side has its own bookmarks attached to bolts 13*. The whole structure is supported by three vertical supports 16, one at each corner 22 of tri-top 15. Support 16 also act as stops for the swinging assemblies. Each support 16 is connected at the top to tri-top 15 and at the bottom to revolving base 17. Base 17 has a hexagonal shape similar to tri-top 15, but does not have angle a cut into the edges. Bearing 18 is connected to the base 17 and allows the entire structure to revolve (FIG. 6B). Tri-base 19 is connected to the bearing 18** and serves as a stationary support for the above revolving structrue.

OPERATION OF INVENTION

This invention operates to hold books open using a combination of gravity and spring tension. Initially, the book holder is in a position as shown in FIG. 1. A book is inserted into the book holder by grasping spring clip 3 with one hand and pulling the swinging-assembly (FIG. 3) outward against the force of gravity to the limit where vertical-swing 2 is stopped by face element 4. An open or closed book is placed in the stand with the other hand so that the bottom of the book rests upon the book-support 2, and the back of the book rests against the face 4. Spring clip 3 is released, and the swinging-assembly swings down under the influence of gravity until page-press 3*a* presses against the pages of the open book.

Book-support 1 supports the bottom of a book, it can be made deep enough to hold practically any book thickness.

Spring-clip 3 acts as a page retaining system. Spring tension is transferred via spring 7 and spring-lever 3*b* and page-press 3*a* to the pages, thus pressing the pages open as the swinging-assembly swings down under the influence of gravity. Page-press 3*a* is a height above book-support 1 such that the maximum amount of page can be gripped without interfering with reading the page. A page can be turned by rotating spring-clip 3 into a partially or fully down position with one hand (see FIGS. 2 & 3), and turning the page with the other. Spring-clip 3 stays in the fully down position when rotated to stop, thus freeing both hands in a case where the book holder user wishes to flip freely through the book. In order to restrain the pages open again, the user only has to flip up the spring-clip 3 into the up position.

When spring-clip 3 is fully up and no book is in the book holder, a space is provided between page holder 3*a* and face element 4 to allow the placement of loose papers. Swing-stop 5 keeps the swinging assembly from traveling back too far, and thus sets the above mentioned gap.

Bookmarks 11 may be placed between pages in order to refer to those pages later. The bookmarks 11 are easier to access if they are flipped over the top of the book holder and allowed to hang behind the stand before a book is inserted.

CONCLUSION, RAMIFICATION, AND SCOPE OF INVENTION

Thus the reader can see that this invention provides a much improved, easy to use, and very versatile book and note holder.

While my above description contains many specificities, these should not be construed as limitations on the scope of the invention, but rather as an exemplification of the three preferred embodiments thereof. For example, there are many ways of achieving a spring tensioned page press which will stay open when pulled all the way down; any other effective spring system can be incorporated into my invention without compromising the novelty of my invention. My invention should not be bound by specifics such as these: rather it should be examined in light of its general principles of operation involving the unique combination of gravity and spring tension.

It is easy to envision embodiments which employ different numbers of book holders: two-sided stationary, two-sided revolving, four-sided revolving, etc. Other methods of providing a swinging movement for the swinging base can also be imagined. For instance, the book-support could slide in and out on rails under the influence of gravity. Embodiments can be imagined where spring tension replaces the force of gravity for the movement of the book-support.

Accordingly, the scope of invention should be determined not by the embodiments illustrated, but by the appended claims and their legal equivalents.

This invention can be made using a variety of different materials and joining techniques. Wood and plastic are the inventors current material preferences, but any suitable strong material can be utilized. Glue, screws, or other suitable joining techniques can be used in joining.

I claim:

1. A reading stand for supporting reading material in a position for examination comprising:

(a) a swinging-assembly of sufficient rigidity and size to support up to almost any size of reading material, said swinging-assembly being substantially "L" shaped and having a horizontal book-support element and a vertical-swing element;

(b) clip means located on an end of said horizontal book-support away from said vertical-swing element to provide pressure on the pages of an open book;

(c) a stand having one front panel or face with upper and lower ends for receiving said swinging-assembly, said stand being at an angle with respect to a horizontal surface;

(d) pivotal attachment means attached on the end of said vertical-swing element away from the book-support element, and to the upper end of said front panel or face wherein the vertical-swing can swing closer and further to said face, and such that said book support lies below the lower end of the face, and protudes in front of said face at a substantially perpendicular angle during the entire swing;

(e) tension means between said clip means and said book support means for applying a closing force on said clip;

(f) wherein the reading material may be placed with its backside leaning against the front of said face, with the bottom of the reading material upon the book-support, and said swinging-assembly adjusting to a different material thickness.

2. The reading stand of claim 1 wherein the clip means is a spring-clip.

3. The reading stand of claim 2 wherein said spring-clip comprises a page-press shaped to achieve best contact pressure towards the outside of the page of an open book.

4. The reading stand of claim 1 wherein said clip means is pivotably secured to said book-support.

5. The reading stand of claim 1 wherein the tension means is a spring.

6. The reading stand of claim 1 wherein the pivotal attachment means is a swing-hinge.

7. The reading stand of claim 1 also comprising stop means to limit the swing of the swinging-assembly.

* * * * *